US009802791B2

(12) United States Patent
Ludwig et al.

(10) Patent No.: US 9,802,791 B2
(45) Date of Patent: Oct. 31, 2017

(54) ESCALATORS AND MOVING WALKWAYS

(71) Applicant: THYSSENKRUPP ELEVATOR AG, Essen (DE)

(72) Inventors: Reiner Ludwig, Schwarzenbek (DE); Detlev Lindemeier, Reinbek (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 0 days.

(21) Appl. No.: 14/907,314

(22) PCT Filed: Jul. 4, 2014

(86) PCT No.: PCT/EP2014/001850

§ 371 (c)(1),
(2) Date: Jan. 25, 2016

(87) PCT Pub. No.: WO2015/010770

PCT Pub. Date: Jan. 29, 2015

(65) Prior Publication Data

US 2016/0167930 A1 Jun. 16, 2016

(30) Foreign Application Priority Data

Jul. 23, 2013 (DE) ..... 10 2013 107 869

(51) Int. Cl.
*B66B 23/10* (2006.01)
*B66B 23/12* (2006.01)

(52) U.S. Cl.
CPC ..... *B66B 23/10* (2013.01); *B66B 23/12* (2013.01)

(58) Field of Classification Search
CPC ..... B66B 23/145; B66B 23/14; B66B 23/10; B66B 23/12
See application file for complete search history.

(56) References Cited

U.S. PATENT DOCUMENTS 2,570,135 A 10/1951 Loughridge
4,175,652 A * 11/1979 Satou ..... B66B 23/145 104/248

(Continued)

FOREIGN PATENT DOCUMENTS

DE 905348 B 3/1954
DE 4204814 A1 8/1993

(Continued)

OTHER PUBLICATIONS

English Translation of International Search Report for PCT/EP2014/001850 dated Sep. 30, 2014 (mailed Oct. 10, 2014).

(Continued)

*Primary Examiner* — Mark A Deuble

(74) *Attorney, Agent, or Firm* — thyssenkrupp North America, Inc.

(57) ABSTRACT

People movers, such as escalators and moving walkways, for instance, may comprise a support member belt comprised of a plurality of support members guided on rails. The support members may be, for example, steps of an escalator or pallets of a moving walkway. Each support member may be secured to a pair of drag rollers that runs on the rails, and each support member may include a roller spindle that is held rotationally conjointly in or on a body of the support member. Between the roller spindle and the body of the support member, there may be a plug-in connection by way of which the roller spindle is maintained against an undercut under bias of a latching device.

14 Claims, 7 Drawing Sheets

(56) References Cited

U.S. PATENT DOCUMENTS

| | | | | |
|---|---|---|---|---|
| 5,293,982 | A * | 3/1994 | Ahls | B66B 23/024 198/332 |
| 5,806,653 | A * | 9/1998 | Ahls | B66B 23/026 198/326 |
| 5,988,350 | A | 11/1999 | Nusime et al. | |
| 8,322,508 | B2 | 8/2010 | Matheisl | |
| 2003/0025386 | A1 | 2/2003 | Brake | |

FOREIGN PATENT DOCUMENTS

| | | | |
|---|---|---|---|
| DE | 20301358 | U1 | 6/2003 |
| EP | 0169349 | A1 | 1/1986 |
| GB | 1373795 | A | 11/1974 |
| WO | 2009047146 | A | 4/2009 |
| WO | 2012/154166 | A1 | 11/2012 |

OTHER PUBLICATIONS

English Abstract of EP0169349.
Machine Translation of Abstract of DE20301358.
English machine translation of DE905348B.

* cited by examiner

ESCALATORS AND MOVING WALKWAYS

CROSS REFERENCE TO RELATED APPLICATIONS

This application is a U.S. National Stage Entry of International Patent Application Serial Number PCT/EP2014/001850, filed Jul. 4, 2014, which claims priority to German Patent Application No. DE 102013107869.9 filed Jul. 23, 2013, the entire contents of both of which are incorporated herein by reference.

FIELD

The present disclosure relates to escalators, moving walkways, and step and pallet belts for escalators and moving walkways.

BACKGROUND

Escalators and moving walkways have long been known. Escalators comprise steps, and moving walkways comprise pallets which are typically guided, by way of two chain rollers and two drag rollers, on rails. Here, the step or pallet is connected in the region of the chain roller to the pallet chain or step chain of the escalator or of the moving walkway, and is also laterally guided there. By contrast, the drag rollers typically run on flat rails without additional lateral guidance.

To ensure smooth running, various measures have become known. For example, for approximately 50 years, the running surfaces of the drag rollers have been coated with rubber or, nowadays, plastic in order to ensure reduced rolling noise. It has also been proposed for the steps or pallets to be sprayed with noise-deadening material from the underside.

Furthermore, in EP 0 169 349 A1, it has been proposed for the roller spindles themselves to be mounted flexibly in a type of silent block. This solution is duly basically effective when the step or pallet is guided over unevennesses on the rail, because the vibrations are dampened in this way. Said approach however has not become established because, in the case of unilateral loading of said step, the step sinks downward there and accordingly comes dangerously close to the balustrade, to the point of grinding against the balustrade or even carrying the balustrade along.

If it is intended to prevent this, it is duly possible for the gap between the step or pallet and the balustrade to be increased, for example to 15 mm. This is however undesirable and is objectionable from a safety aspect, because then the risk of injury to passengers is even greater.

Various other types of fastening of the drag rollers to the steps are also provided. A mechanically expedient solution is presented in GB 1 373 795. In said document, the steel spindle of the drag roller is cast into the light-metal body of the step. Such a step is however highly cumbersome to produce.

Furthermore, DE 203 01 358 U1 has disclosed a mounting of a step by way of screwed bearing journals secured by locknut, which bearing journals form the roller spindles. Said solution is likewise highly stable and permits a small lateral clearance toward the balustrade.

Owing to the unilateral mounting, said screw connections are subject to considerable moments; the burden is dependent on the load, that is to say generally the number of passengers being transported by the respective step or pallet.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

Figure 1:
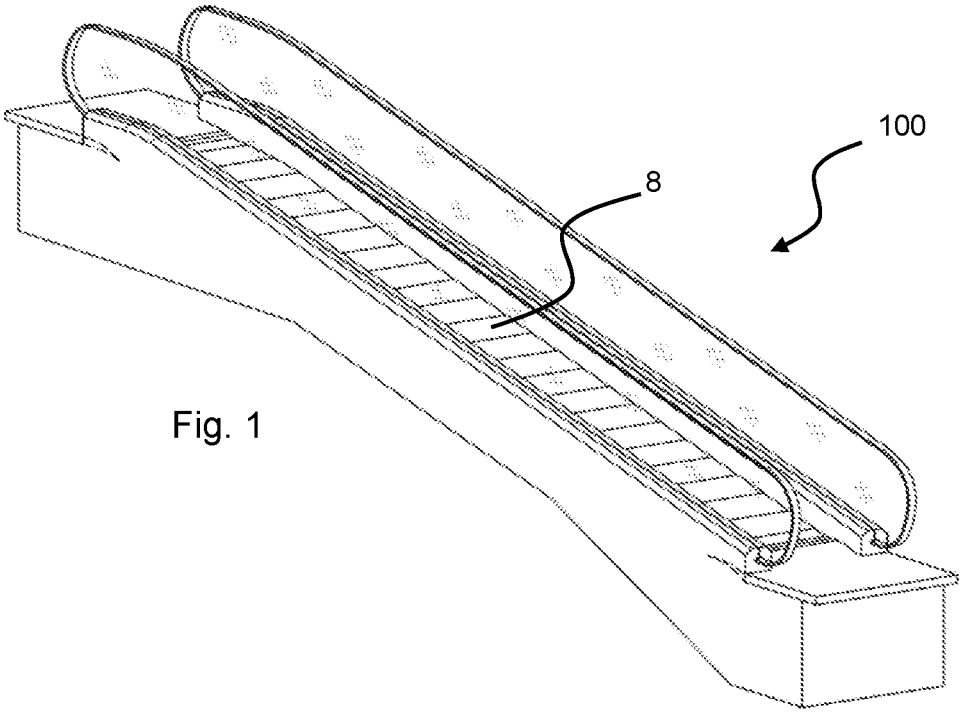
FIG. 1 is a perspective view of an embodiment of a people mover of the present disclosure in the form of a moving walkway having a plurality of pallets that are guided on rails and form a pallet belt.
Figure 2:
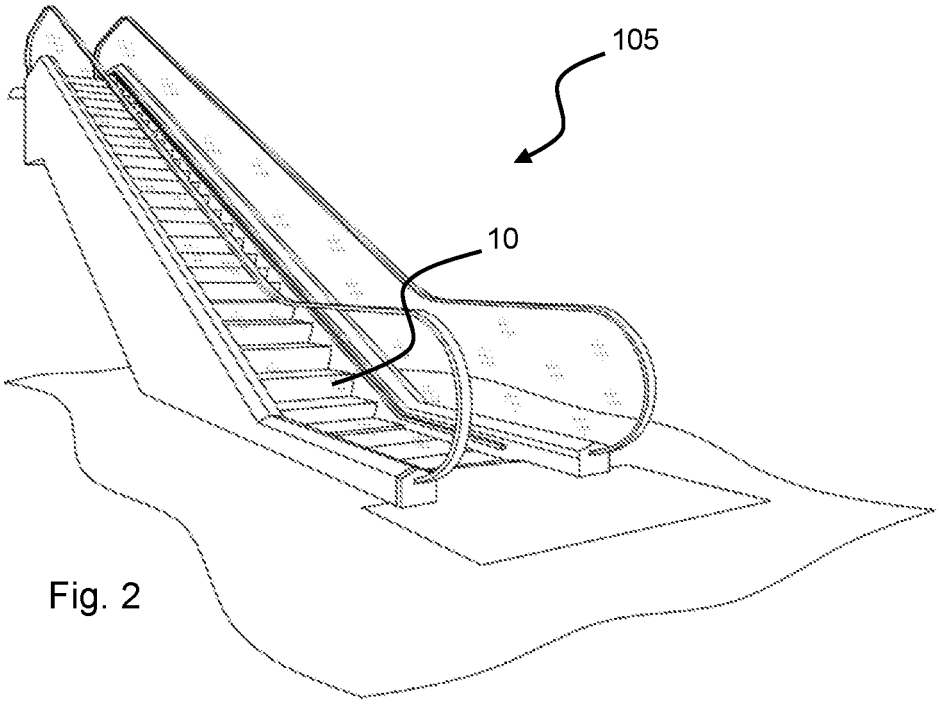
FIG. 2 is a perspective view of an embodiment of a people mover of the present disclosure in the form of an escalator having a plurality of steps that are guided on rails and form a step belt.

Referring to FIGS. 1 and 2, people movers, such as moving walkways 100 and/or escalators 105 respectively, are disclosed and include those that have a support member belt, such as a step belt or pallet belt, comprised of a multitude of support members, such as steps 10 or pallets 8 respectively, guided on rails. In some examples, each support member, such as a step or pallet, may comprise at least two drag rollers that run on rails. Example drag rollers may comprise a roller spindle that is held rotationally conjointly in or on a body of the step or pallet.

Therefore, one example objective of the present disclosure is to improve an escalator or a moving walkway such that, even in the event of fluctuating loads, good durability is made possible. The production of an escalator or of a moving walkway should furthermore advantageously be simplified.

Figure 3:
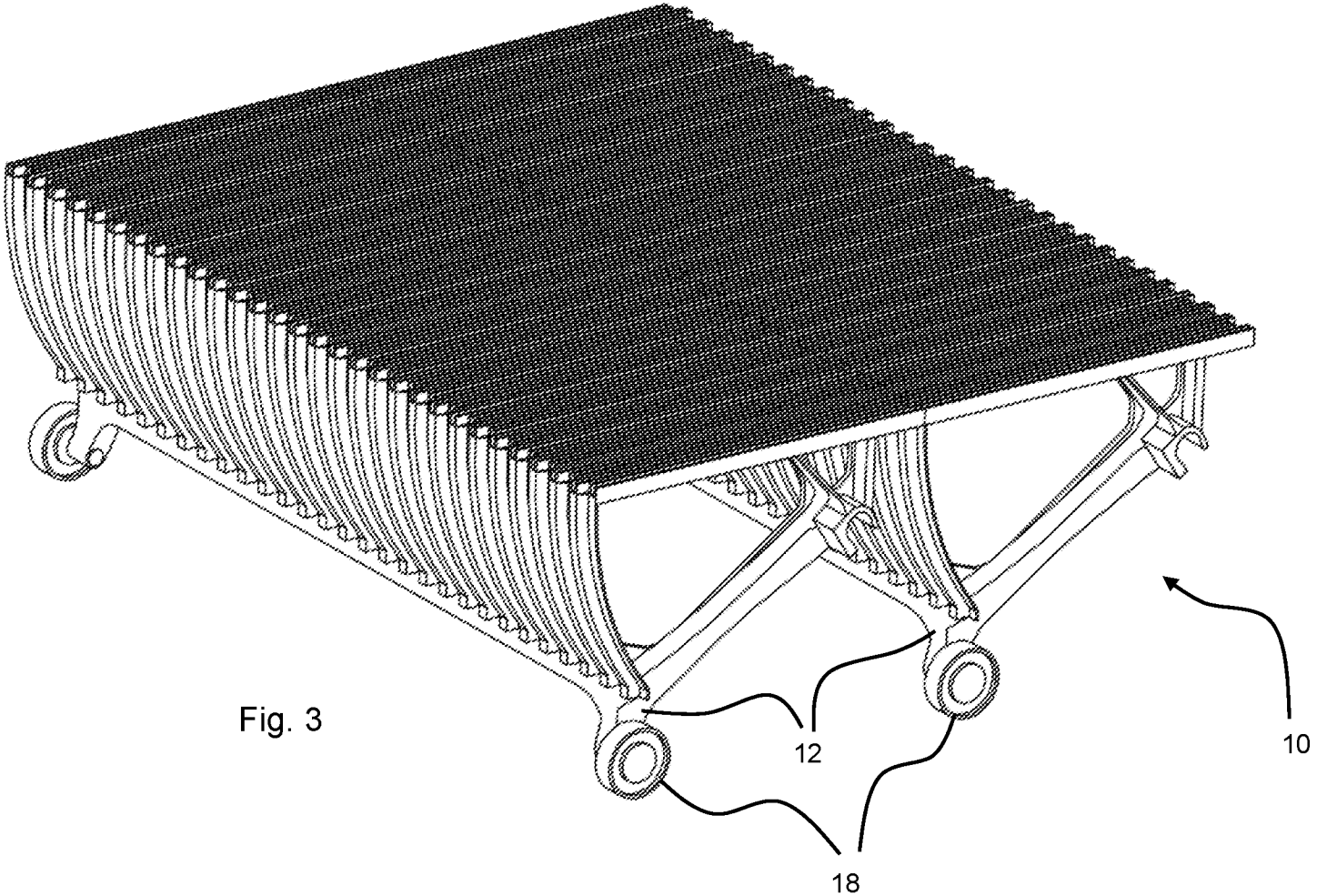
FIG. 3 is a perspective view of an exemplary embodiment of two consecutive support members, in this case steps from the step belt of the people mover of FIG. 2, in which each step includes at least two drag rollers.
Figure 4:
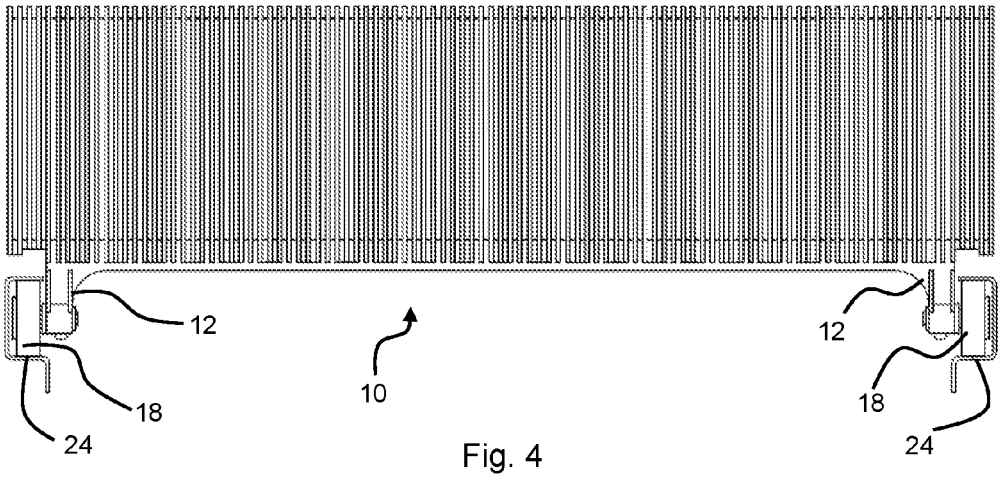
FIG. 4 is a rear view of the steps from the people mover of FIGS. 2 and 3, showing the at least two drag rollers being guided or running in rails of the people mover of FIG. 2.
Figure 5:
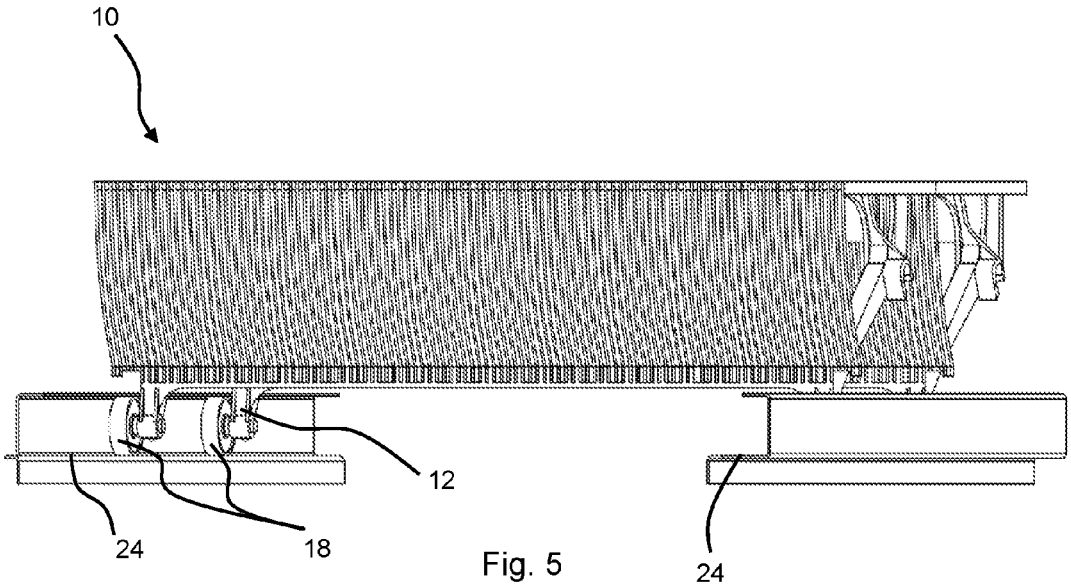
FIG. 5 is a rear and side perspective view of the steps from the people mover of FIGS. 2 and 3, showing how each of the drag rollers on a first side of each of the two depicted steps is guided or runs in an exemplary rail of the people mover of FIG. 2.

Referring to FIGS. 3-5, the invention proposes a people mover, such as an escalator or moving walkway, comprising a plurality of support members that form a belt, such as a step belt or pallet belt that is respectively made up of a plurality of successively disposed steps 10 or pallets 8 that are guided on rails, wherein each support member (e.g. step 10 or pallet 8) comprises at least two drag rollers 18, which are mounted on the support member (e.g. step 10 or pallet 8) and which each run on rails 24. Each drag roller has a roller spindle which is held rotationally conjointly in or on a body of the support member (e.g. step 10 or pallet 8), wherein, between the roller spindle and body, there is formed a plug-in connection by way of which the roller spindle is held with a resilient latching connection against an undercut, in particular of the body, under preload of the latching device. Put another way, those having ordinary skill in the art will understand that the latching device may be said to be 'biased,' 'prestressed,' 'resilient,' or the like.

In one particularly advantageous refinement of the invention, in each case between the roller spindle and the body, there is formed an adhesive connection by way of which the roller spindle is held rotationally conjointly. That is to say, here, in addition to the latching connection, the roller spindle is advantageously adhesively bonded into the body.

This advantageously generates a secure seat of the roller spindle, which itself withstands high axial forces. Furthermore, rotational conjointness is advantageously achieved in an inexpensive manner by way of the adhesive bonding. Furthermore, adhesive bonding of the roller spindle into the corresponding receptacle of the body advantageously permits a greater radial and/or axial clearance between spindle and receptacle, such as occur in particular in the case of the spindle and/or body being manufactured by way of aluminum pressure die casting.

A further advantageous refinement of the invention provides that an undercut is formed on a surface, situated opposite the drag roller, of the body.

The roller spindle advantageously comprises a ledge, the ledge surface of which faces toward the body. The ledge advantageously bears against the body under preload applied by the latching device.

According to a further advantageous aspect of the invention, the undercut is in the form of an encircling groove in a bushing of the body, into which groove there is engaged, with snap-in action, a circular spring which is formed in a roller groove of the roller spindle.

In particular, it is provided that the latching device comprises a circular spring which is preloaded so as to act in an outward direction and in relation to which the roller groove has an oversize as viewed in an axial direction of the roller spindle.

The roller groove preferably has, as viewed in a radial direction of the roller spindle, a depth equal to or greater than the radial height of the circular spring.

A further advantageous refinement of the invention provides that the undercut comprises a body effective area pointing away from the drag roller, which body effective area is in particular of oblique form, at an angle of greater than 90° with respect to the spindle, or of concave form.

The circular spring preferably comprises a convex or oblique side surface which bears under preload against the body effective area. Here, the circular spring is advantageously clamped between the body effective area and the roller groove effective area and, owing to the outwardly directed preload of the circular spring, presses the ledge of the roller spindle against the body.

In a further advantageous refinement of the invention, it is provided that, when the ledge comes into contact with the body as the roller spindle is inserted into the body, the roller spindle automatically snaps in, or engages with latching action, at the undercut by way of the latching device.

The body of the step or pallet is preferably formed from a light metal or plastic. It is particularly preferable for the body-side bushing to be in the form of an insert-molded or cast-around steel part.

A further advantageous refinement of the invention provides that the body comprises, on the bushing, an insertion bevel, the radial height of which corresponds to at least one third of the radial height of the circular spring.

An undercut is preferably formed on the roller spindle, against which undercut the resilient latching connection acts.

To solve the problem mentioned in the introduction, there is also proposed an escalator or moving walkway, comprising a step belt or pallet belt composed of a multiplicity of steps or pallets guided on rails, wherein each step or pallet comprises at least two drag rollers, which are mounted on the step or pallet and which each run on rails, with a roller spindle which is held rotationally conjointly in or on the body of the step or pallet and wherein, between the roller spindle and body, there is formed a plug-in connection by way of which the roller spindle is held with a frictionally engaging connection against the body. In particular, it is provided that the roller spindle is held against the body with a frictionally engaging connection by way of a clamping element, preferably a clamping body.

To solve the problem mentioned in the introduction, there is also proposed an escalator or moving walkway, comprising a step belt or pallet belt composed of a multiplicity of steps or pallets guided on rails, wherein each step or pallet comprises at least two drag rollers, which are mounted on the step or pallet and which each run on rails, with a roller spindle which is held rotationally conjointly in or on the body of the step or pallet, and wherein, between the roller spindle and body, there is formed a plug-in connection by way of which the roller spindle is held with a clamping connection against an undercut, in particular of the roller spindle or of the body under preload of the clamping connection.

The clamping connection preferably comprises a clamping element which is more flexible than the body, wherein the clamping connection is preferably realized by way of a clamping device.

It is advantageously provided that a clamping element of the clamping connection or of the clamping device extends between the roller spindle and the body and bears in particular both against the body and against the roller spindle.

Furthermore, to solve the problem mentioned in the introduction, there is proposed an escalator or moving walkway, comprising a step belt or pallet belt composed of a multiplicity of steps or pallets guided on rails, wherein each step or pallet comprises at least two drag rollers, which are mounted on the step or pallet and which each run on rails, with a roller spindle which is held rotationally conjointly in or on the body of the step or pallet, and wherein, between the roller spindle and body, there is formed an adhesive connection by way of which the roller spindle is held rotationally conjointly.

Furthermore, to solve the problem mentioned in the introduction, there is proposed a step or pallet for an escalator or a moving walkway respectively, wherein the step or pallet comprises at least two drag rollers, which are mounted on a roller spindle which is held rotationally conjointly in or on the body of the step or pallet, and wherein, between the roller spindle and body, there is formed a resilient latching connection, or a frictionally engaging connection with a clamping element, or a clamping connection, which is held against an undercut under preload.

According to the invention, it is duly particularly expedient for the mounting of the roller with its roller spindle on the body of the step or pallet to firstly be purely metallic, which in this regard results in little deflection. According to the invention, the accommodation of moments by the axial or lateral mounting is mechanically equalized: the accommodation of moments is realized by way of the mutually opposite bearing surfaces of a bushing with the roller spindle as bearing journal, wherein it is self-evident that the diameter of said plug-in connection, and the contact pressure resulting therefrom, is adapted to the requirements.

By contrast, the axial mounting is realized by way of a resilient latching connection which presses a ledge on the bearing journal against a corresponding counterpart shoulder of the body, and thus ensures that the drag rollers are held without clearance, and thus in rattle-free fashion.

According to the invention, it is particularly expedient if, by way of suitable insertion bevels and undercuts, it is ensured that, when the ledge makes contact, the latching device according to the invention automatically engages with snap-in action and at the same time holds the roller spindle under stress in the axial direction. Here, the undercut is advantageously formed in each case on a surface, situated opposite the drag roller, of the body.

By way of the insertion action, the assembly process can be simplified considerably, and it is not necessary for an insert part, such as is provided in GB 1 373 795, to be jointly cast in. This shortens the casting process considerably, and likewise yields a cost saving.

According to the invention, it is accordingly expedient that, firstly, large support surfaces are provided for the accommodation of moments, which support surfaces extend between the roller spindle, which forms the journal of the plug-in connection, and the passage recess, which forms the bushing of the plug-in connection, of the body of the step or pallet. Said surfaces are capable of accommodating the forces generated as a result of the unilateral mounting and the lever action thereby induced.

By contrast, the forces in the axial direction of the roller spindle are considerably lower: since the rail for the drag roller is typically in the form of a flat rail, no lateral forces are generated for the lateral guidance of the step or pallet. These are rather accommodated entirely by way of the chain roller and the mounting thereof. Accordingly, all that remain are friction-generated axial forces which can be accommodated by the undercut and the spring element of the latching connection.

The plug-in connection according to the invention with latching connection also makes it possible for a drag roller with the roller spindle to be rapidly exchanged, for example in the event of damage thereto.

Depending on the size of the escalator, different sizes of drag rollers are required. The mounting thereof is also simplified according to the invention by way of the compact and easily assemblable arrangement of the drag rollers.

A particular advantage according to the invention is that the latching device according to the invention, which preferably comprises a circular spring, engages with latching action on an undercut of the body. The undercut may, in a preferred refinement, be formed on that surface of the body which is situated opposite the drag rollers; in this exemplary embodiment, the circular spring engages with latching action when the roller spindle has passed through the bushing of the body to such an extent that the circular spring emerges again on the opposite side.

Instead of the realization of the undercut, as it were, on the rear side of the body of the step or pallet, the undercut may also be realized in a groove in the bushing of the body, a so-called body groove. In the case of this solution, the circular spring of the latching connection is received in protected fashion, such that the tendency for fouling is lower.

The invention is not restricted to the realization of the latching connection by way of a spring washer or circular spring. Instead, use may also be made of any other desired latching device that engages with latching action when the roller spindle has been fully inserted. In this context, it is at any rate preferable for the latching device, even in the engaged state, to still exert tensile forces which ensure the contact between the shoulder of the body and the ledge of the roller spindle journal. For example, for this purpose, use may be made of one or more latching mechanisms, or of a starlock washer which is pressed onto the roller spindle.

In a modified refinement, it is provided that, instead of the circular spring which is received in the groove of the roller spindle and which is preloaded in an outward direction, use is made of a circular spring which is received in the groove of the body of the pallet or of the step and which is preloaded in an inward direction.

According to the invention, it is in any case expedient for oblique surfaces to be formed on the insertion opening of the body and/or of the roller spindle, which oblique surfaces compress or expand the circular spring, respectively, counter to the stress thereof in order to allow it to slide easily along the bearing surfaces until the circular spring engages with a snap-in action at the undercut.

In a further advantageous refinement of the invention, provision is made for a clamping device to be used for securing the plug-in connection according to the invention. Said clamping device acts with clamping action between the body of the step or pallet and a roller spindle on which drag rollers run. The clamping may be implemented in any suitable manner by way of a clamping element which preferably extends between body and roller spindle and which, by way of oblique surfaces or by way of a compression, generates a contact pressure with respect to the body and/or with respect to the roller spindle.

Owing to the clamping device which is held under pressure, the flexibility is virtually as low as, for example, in the case of a screw connection, wherein it is self-evident that the material of the clamping device is preferably less hard than the material of the ledge or pallet and of the spindle only to a small extent. For example, a clamping element composed of copper or, for example, a hard plastic may be realized, and may extend as a sealing bushing between step and body.

According to the invention, it is particularly expedient for the dimensioning to be selected such that, by way of the preload of the groove, effective areas of the body and of the roller spindle are pressed in opposite directions, and thus the contact between the ledge and the shoulder is realized under preload.

Referring to FIG. 1, an embodiment of a people mover of the present disclosure is shown in the form of a moving walkway 100 having a plurality of pallets 8 that form a pallet belt.

Referring to FIG. 2, an alternate embodiment of a people mover of the present disclosure is shown in the form of an escalator 105 having a plurality of steps 10 that form a step belt.

FIGS. 3-5 show several views of an embodiment of two consecutive support members of the people mover of the type shown in FIG. 2, which takes the form of an escalator. Thus in FIGS. 3-5, the support members are in the form of steps 10 of the escalator. As can be seen, each step 10 (i.e. support member) of the escalator 105 includes at least two drag rollers rotatably coupled to a respective body 12 or body structure of each step 10. Each of the two drag rollers 18 on each step 10 is guided on, or runs on, a respective rail 24 of the escalator 105 (e.g. people mover).

Figure 6:
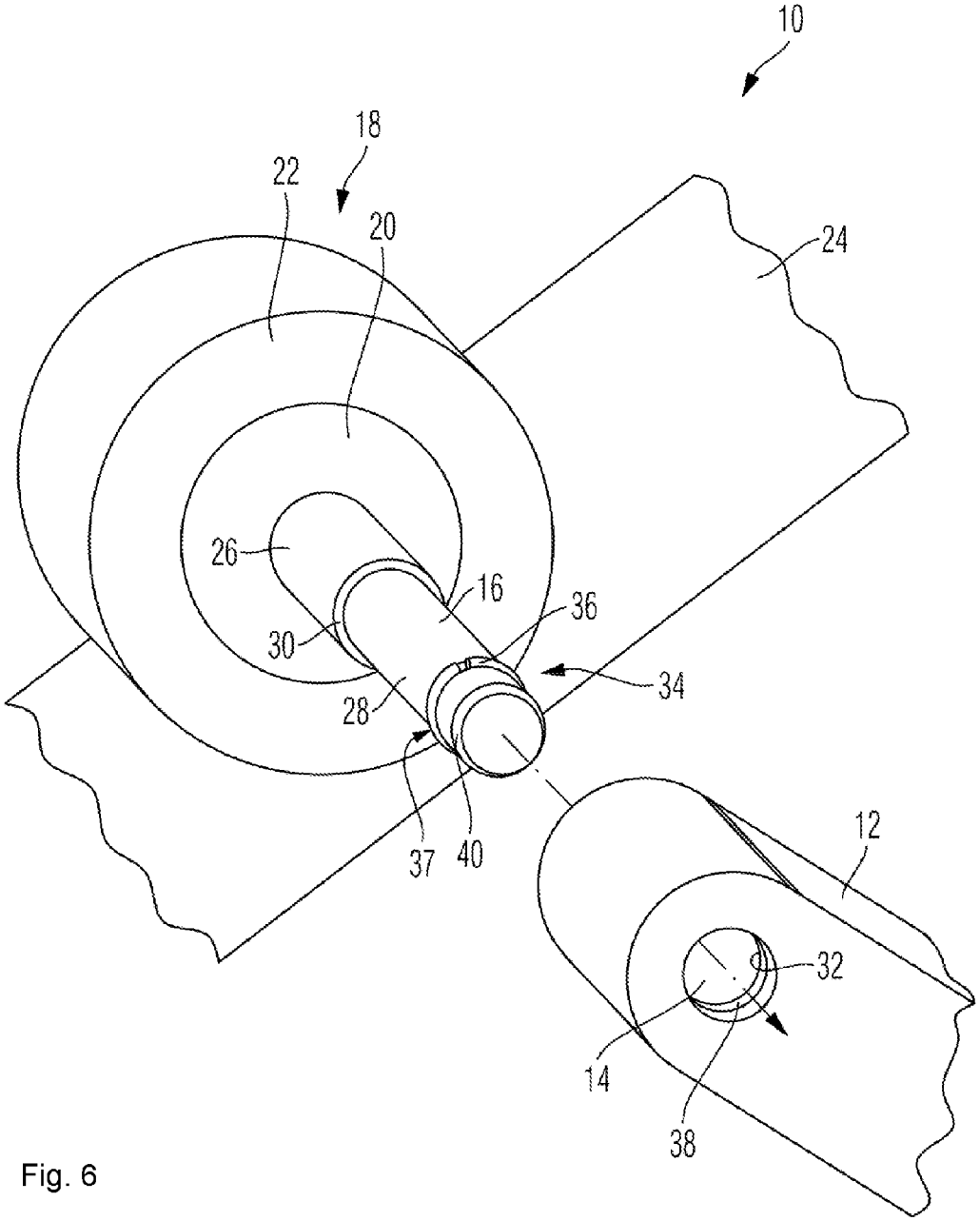
FIG. 6 is a schematic perspective view of an example drag roller prior to being fastened to a step or a pallet.

Referring to FIG. 6, a detail view shows, a body 12 of a step 10 of an escalator. The body 12 comprises a passage recess 14 which is designed for receiving a roller spindle 16 of a drag roller 18.

The drag roller 18 comprises, in a manner known per se, a bearing 20 which is fixedly attached to the roller spindle 16. A drag roller body 22 is applied to the outer shell of the bearing 20, which drag roller body is coated with a running surface layer (not illustrated) composed of a relatively soft plastics material. The drag roller 18 runs on a flat rail 24, which is realized in fixed form and which does not form a lateral guide for the drag roller 18, but rather serves exclusively for supporting the drag roller 18 with respect to the loads that must be accommodated by the step 10.

For the accommodation of the loads, the passage recess 14 is of extremely deep and solid form and is furthermore on a body part of the step 10, the extent of which body part points in the load direction, that is to say perpendicular to the surface of the flat rail 24.

The roller spindle 16 according to the invention is of special design. That part 26 which is adjacent to the bearing 20 is of slightly thickened form. In relation to the bearing journal 28 itself of the roller spindle 16, said part forms a ledge 30 which points toward the body 12. The bearing journal 28 is cylindrical, or else may be of very slightly conical form, with a cone angle of for example one degree, preferably a cone angle of less than 3.5°, in order to ensure even more secure mounting. The bushing 32 that is formed in the passage recess 14 comprises, in any case, a surface which is exactly parallel to the surface of the bearing journal 28. Said two surfaces, which are situated opposite one another, serve for accommodating the load of the drag roller 18 in order to transmit said load to the body 12, and are of a size which is sufficient to ensure that the contact pressure is not excessively high.

In the profile of the extent of the bearing journal, preferably at the free end thereof, there is formed a latching device 34. Said latching device comprises a circular spring 36 which is mounted in a roller groove 37, specifically with a clearance, in such a way that it is preloaded in an outward direction.

In this embodiment, in addition to the roller groove 37 which is adapted to the circular spring 36, there is a so-called body groove 38 for forming the undercut in the bushing 32.

In the inserted state of the bearing journal 28, the circular spring 37 engages with latching action on the undercut, that is to say in this case into the body groove 38.

Instead, it is also possible for that surface of the body 12 which points away from the roller 18 to form the undercut. The circular spring 36 then engages with latching action in an audible manner.

In the inserted state, the bearing journal 28 is received entirely in the passage recess 14, and also projects out of the latter slightly, as can be seen from FIG. 2.

To facilitate the insertion, the bearing journal 28 comprises, on its front end, an oblique surface 40.

In an advantageous design variant of the invention, between the roller spindle 16 and body 12, there is formed an adhesive connection by way of which the roller spindle 16 is held rotationally conjointly. Here, the roller spindle 16 is advantageously adhesively bonded into the passage recess 14 of the body 12. In particular, it is provided that the steps or pallets are produced with the corresponding components, in particular the roller spindle 16 and the body 12, in an aluminum pressure die casting process. Here, the latching connection advantageously provides an additional securing action in addition to the adhesive connection, which in particular prevents a release of the roller spindle 16 from the passage recess 14, advantageously also in the event of a fault, in which the adhesive connection does not withstand an acting load.

Figure 7:
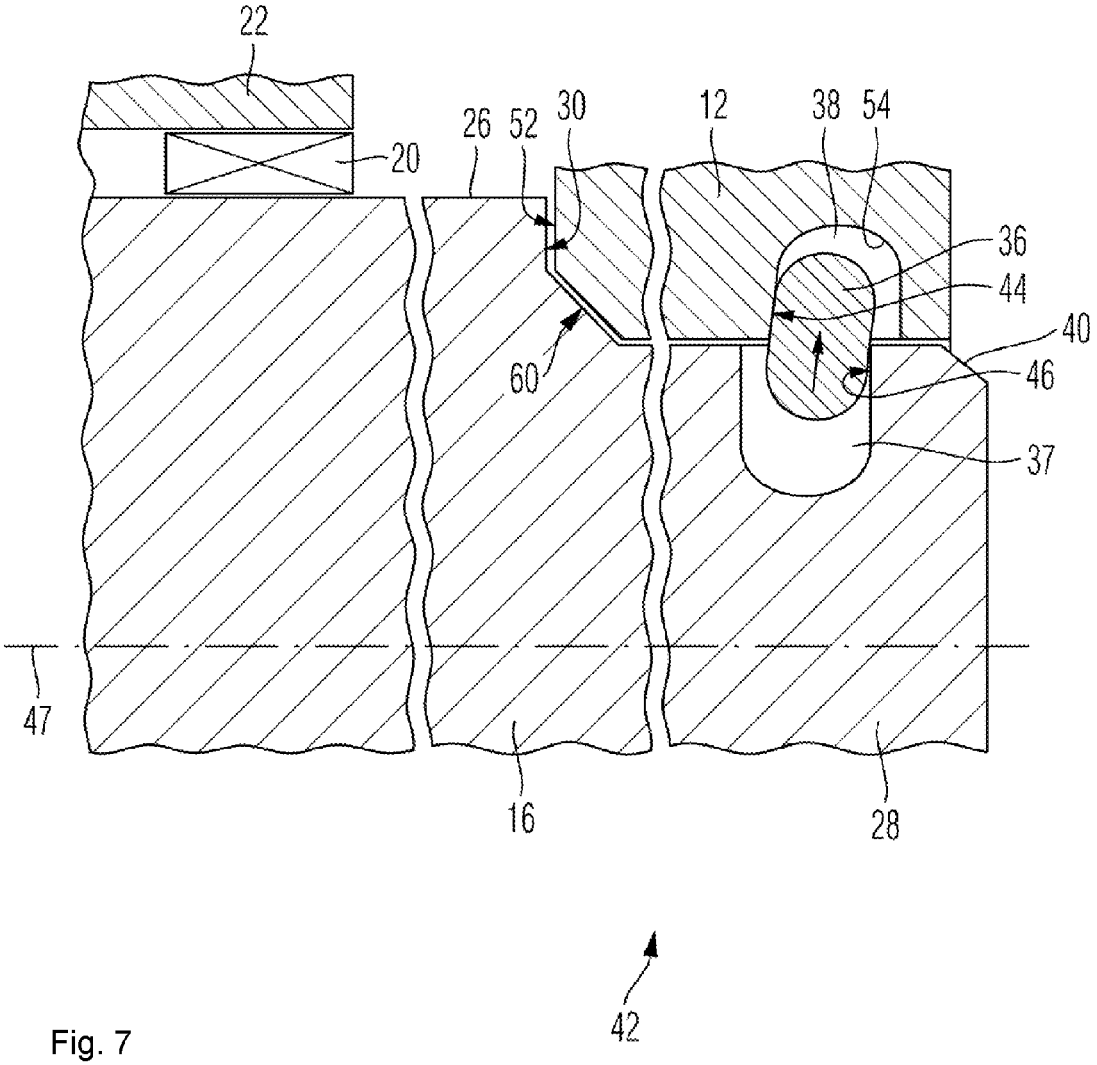
FIG. 7 is a sectional view of an example body of a step secured to an example drag roller.

Referring to FIG. 7, an embodiment of the design of the plug-in connection 42 is shown. Here, the same reference signs denote identical or corresponding parts.

In the exemplary embodiment illustrated, the circular spring 36 has a non-circular, somewhat elongate cross section, wherein the longitudinal axis extends substantially radially. The circular spring 36 lies between a body effective area 44 and a roller groove effective area 46. The body effective area 44 diverges toward the axis 47 of the bearing journal 28, such that, when the circular spring 36 engages into the body groove 38, the body 12 is pushed toward the drag roller 22. Formed at the transition between the bearing journal 28 and the part 26 of the roller spindle 16 is the ledge 30 which bears against a correspondingly designed shoulder 52 of the body 12. The action of the circular spring 36 in combination with the body effective area 44 gives rise to a preload between the ledge 30 and the shoulder 52.

Correspondingly, that groove flank 54 which is situated opposite the effective area 44 is free from the circular spring 36. This applies correspondingly to the diagonally opposite opposing flank of the roller groove 37.

On the shoulder 52, too, there is formed an insertion bevel in the direction of the bearing journal 28. Said insertion bevel, which forms the transition between the shoulder 52 and the passage recess 14, pushes the circular spring 36 inward during the insertion of the bearing journal 28, such that said circular spring 36 can slide along the bearing surfaces of the bearing journal 28 and can slide through the passage recess 14 until it engages, with snap-in action, into the body groove 38.

According to the invention, it is accordingly expedient that a drag roller 18 according to the invention can be mounted on the body 12 of a step 10 using just one hand.

Figure 8:
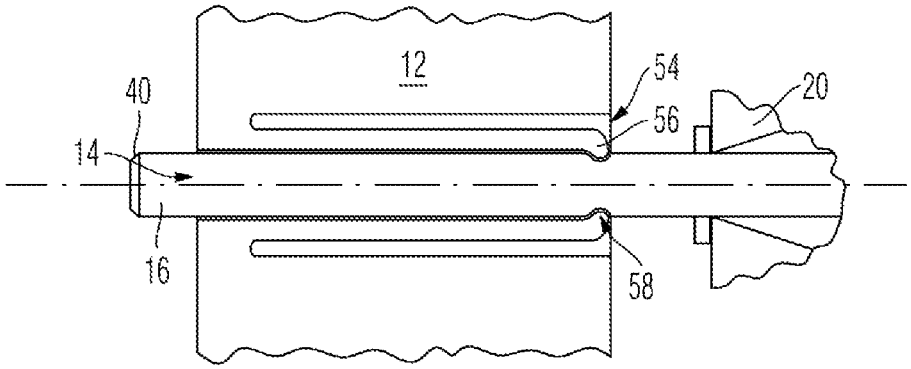
FIG. 8 is a sectional view of an example snap-action sleeve used to secure an example roller spindle to an example body of a step.

Referring to FIG. 8, an alternate embodiment of a drag roller mounting according to the invention is shown. In said figure, and also in the additional FIGS. 9 and 10, the same reference signs are used for identical parts. In said figure, a roller spindle 16 has been inserted into a passage recess 14 in a body 12 of the step. A bearing 20 has been mounted, in a manner known per se, on the roller spindle 16. In this embodiment, the passage recess 14 of the body 12 comprises a snap-action sleeve 54 which comprises inwardly protruding holding ends 56 which engage into an encircling groove 58 of the roller spindle 16 and thus fix the roller spindle 16. The snap-action sleeve 54 is mounted, at that end of the body 16 which is remote from the drag roller bearing 20, on the passage recess 14, such that the holding elements 56 fix the roller spindle 16 by way of an inward elastically resilient action.

Referring still to FIG. 8, in a manner corresponding to FIGS. 6 and 7, the roller spindle 16 comprises, at its front end, an oblique surface 40 by way of which said roller spindle pushes the holding elements 56 apart as it enters.

Figure 9:
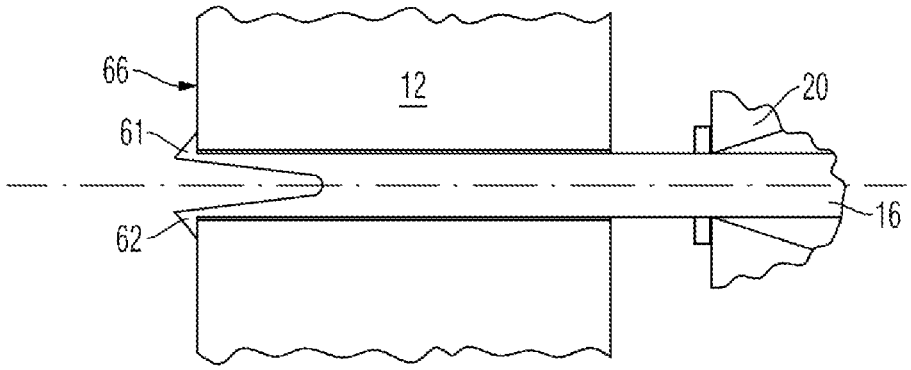
FIG. 9 is a sectional view of example latching tongues disposed on an example roller spindle for securing the roller spindle to an example body of a step.

Referring to FIG. 9, an alternate embodiment of the present disclosure is shown. In this embodiment, the roller spindle 16 is of grooved or slotted form, specifically at its free end opposite the drag roller bearing 20. Said roller spindle tapers off into latching tongues 61 and 62, which point outward and are outwardly preloaded such that they use that surface 66 of the body 12 which points away from the drag roller bearing 20 as an undercut, and form a resilient latching connection there.

Instead of the embodiment illustrated in FIG. 9, it is also possible for the circular spring 36 to be realized in a corresponding roller groove 37 at the same location as the latching tongues 61 and 62, and to likewise provide the desired undercut by way of an outwardly directed preload.

Figure 10:
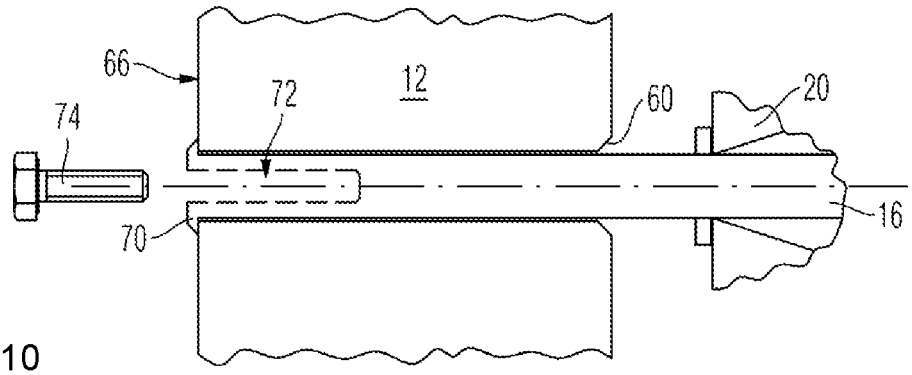
FIG. 10 is a sectional view of an example collar disposed on an example roller spindle for securing the roller spindle to an example body of a step.

Referring to FIG. 10, in an alternate embodiment, the roller spindle 16 comprises, at its remote end, a collar 70 which is slightly beveled on its front end and which, for this purpose, is pushed together as it slides along an insertion bevel 60 of the body 12 during the insertion process.

To permit this, the roller spindle 16 is in the form of a hollow spindle there, and comprises a central recess 72 of large volume.

If a blocking body 74 is introduced into the recess 72, the collar 70 is held securely against the surface 66 in the manner of an undercut. The blocking body 74 may for example be in the form of a screw, wherein the recess 72 is then expediently equipped with a suitable internal thread, or the blocking body may be in the form of a pin, which is quickly hammered in and is held with clamping action in the recess 72.

Figure 11:
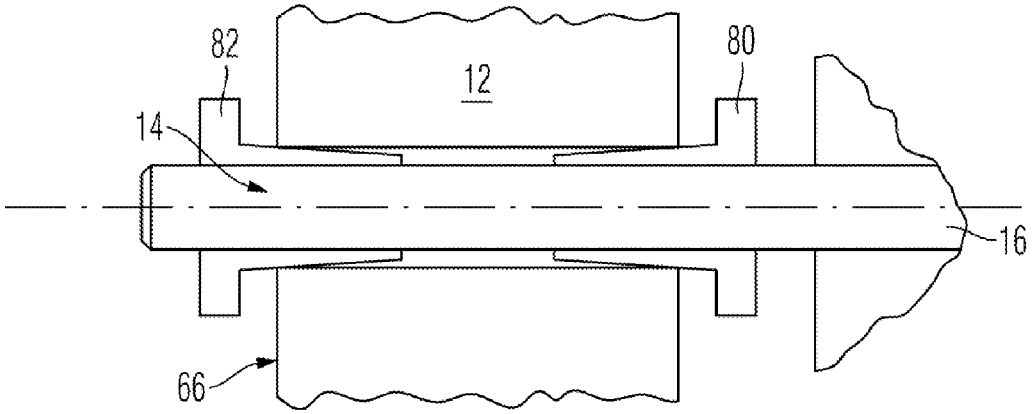
FIG. 11 is a sectional view of example conical clamping bodies used at least to help secure an example roller spindle to an example body of a step.

The refinement as per FIG. 11 provides two conical clamping bodies 80 and 82 which, in the manner of bushings on each side of the body 12, are introduced into the passage recess 14 into the gap between the body 12 and the roller spindle 16, and fix the clamping action of the conical part of the clamping bodies 80 and 82. In a refinement modified in relation to this, it is also possible to make do with just one of the clamping bodies, and to thus also permit fitting from one side, for example.

Figure 12:
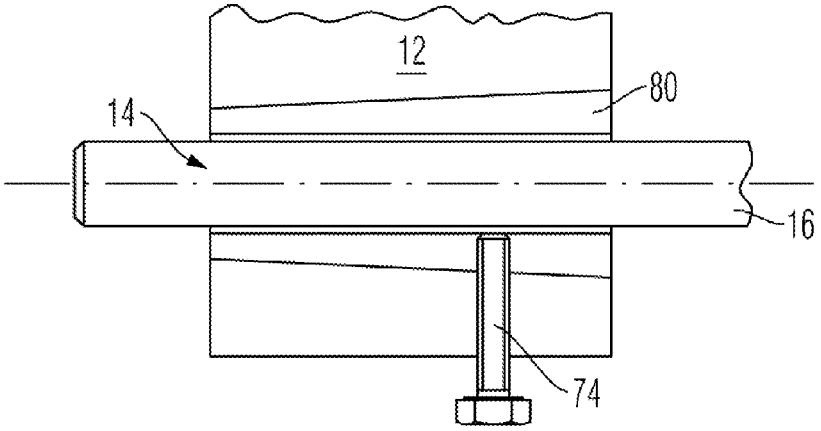
FIG. 12 is a sectional view of another example clamping body and an example blocking body used at least to help secure an example roller spindle to an example body of a step.

The embodiment as per FIG. 12 likewise comprises a clamping body which extends all the way through the passage recess 14 and which comprises an outer surface which corresponds to a conical inner surface of the passage recess 14. At the inside, the clamping body 80 in this embodiment is of cylindrical form and is adapted to the outer circumference of the roller spindle 16. The desired clamping action can be attained by virtue of the clamping body 80 being pressed in from the side of the drag roller (not illustrated here). In this case, too, a blocking body 74 serves for the fixing of the clamping device, that is to say in this case of the clamping body 80, and thus for the mounting of the roller spindle 16 on the body 12 such that said roller spindle is secured against being pulled out.

Whereas it is the case in the embodiments illustrated here that a free mounting of the roller spindle 16 in the axial direction is described in each case, it is self-evident that the invention does not rule out the realization of a stop by way of a suitable ledge, for example as per the ledge 50 from FIG. 7, or with a corresponding spacer sleeve or shim washer in the direction of the bearing 20.

According to the invention, it is also expedient that the selection of the location at which the passage recess 14 is realized in the body 12 and thus in the bearing arm thereof can be adapted to requirements within a broad scope, and in particular, a highly accommodating mounting can be realized.

In particular, in the exemplary embodiments illustrated in the figures, an adhesive connection may additionally be provided between the roller spindle 16 and the body 12, for example by virtue of the roller spindle 16 being adhesively bonded into the passage recess 14 of the body 12.

While the detailed description above differentiates between escalators and moving walkways, those having ordinary skill in the art will understand that terms such as 'people mover,' for example, may be used to refer to a broader category of systems that encompasses both escalators and moving walkways. Likewise, although the detailed description above differentiates between steps for escalators and pallets for moving walkways, those having ordinary skill in the art will understand that terms such as 'support member' may be used to refer to a broader category of components that encompasses both steps for escalators and pallets for moving walkways.

The exemplary embodiments illustrated in the figures and discussed in conjunction therewith serve for the explanation of the invention, and do not restrict the latter.

The invention claimed is:

1. A people mover comprising:

a support member belt comprising a plurality of support members guided on rails; and at least two drag rollers mounted to at least one of the plurality of support members, wherein the at least two drag rollers travel along the rails, wherein each of the at least two drag rollers comprises:

a roller spindle that is inserted into and coupled rotationally conjointly with a recess of a body of the at least one of the plurality of support members, the roller spindle comprising a ledge having a surface that faces the body of the at least one of the plurality of support members; and a latching device disposed at an undercut and configured to couple the roller spindle to the body of the at least one of the plurality of support members, the latching device being biased to both retain the roller spindle at the undercut in a resilient latching connection and force the ledge of roller spindle to bear against the body of the at least one of the plurality of support members.

2. The people mover of claim 1 wherein the ledge contacts the body of the at least one of the plurality of support members as the roller spindle is inserted into the recess of the body, wherein the latching device causes the roller spindle to at least one of automatically snap in at the undercut or engage the undercut with a latching motion.

3. The people mover of claim 1 further comprising an adhesive connection between the roller spindle and the body of the at least one of the plurality of support members for coupling the roller spindle rotationally conjointly.

4. The people mover of claim 1 wherein the undercut is disposed on a surface of the body opposite a closer of the at least two drag rollers.

5. The people mover of claim 1 wherein the undercut comprises an encircling groove disposed in a bushing of the body of the at least one of the plurality of support members, wherein the roller spindle comprises a roller groove, wherein the latching device comprises a circular spring that engages the encircling groove of the bushing and the roller groove of the roller spindle.

6. The people mover of claim 5 wherein the circular spring is biased outwardly towards the rails, wherein the roller groove of the roller spindle is oversized relative to the circular spring when viewed from an axis extending longitudinally through the roller spindle.

7. The people mover of claim 5 wherein the roller groove has a depth equal to or greater than a radial height of the circular spring when viewed in a radial direction of the roller spindle.

8. The people mover of claim 5 wherein the undercut comprises a body effective area that faces away from a closer of the at least two drag rollers, wherein the circular spring comprises a convex side surface or an oblique side surface that bears against the body effective area of the undercut due to bias of the circular spring, wherein the circular spring is clamped between the body effective area of the undercut and an effective area of the roller groove, wherein the bias of the circular spring causes a ledge of the roller spindle to press against the body of the at least one of the plurality of support members.

9. The people mover of claim 5 further comprising an insertion bevel disposed along or adjacent to the roller spindle, wherein the insertion bevel is at least one-third of a radial height of the circular spring.

10. The people mover of claim 1 wherein the body of the at least one of the plurality of support members is formed from a light metal or a plastic.

11. The people mover of claim 1 wherein the roller spindle comprises an undercut against which the latching device acts.

12. A people mover comprising:

a support member belt comprising a plurality of support members guided on rails; and at least two drag rollers mounted to at least one of the plurality of support members, wherein the at least two drag rollers travel along the rails, wherein each of the at least two drag rollers comprises:

a roller spindle that is held rotationally conjointly in or on a body of the at least one of the plurality of support members, wherein a plug-in connection is used to secure the roller spindle to the body of the at least one of the plurality of support members, wherein the plug-in connection comprises a clamping connection, wherein bias from the clamping connection is used to maintain the roller spindle against an undercut.

13. The people mover of claim 12 wherein a clamping element used for the clamping connection is more flexible than the body of the at least one of the plurality of support members.

14. The people mover of claim 12 wherein a clamping element used for the clamping connection extends between and bears against the roller spindle and the body of the at least one of the plurality of support members.

* * * * *